US005564988A

United States Patent [19]

Brooks

[11] Patent Number: 5,564,988

[45] Date of Patent: Oct. 15, 1996

[54] RANGE GOLF SYSTEM

[76] Inventor: Jerry B. Brooks, 524 Florida St., Imperial Beach, Calif. 91932

[21] Appl. No.: 322,440

[22] Filed: Oct. 13, 1994

[51] Int. Cl.[6] ..... A63B 69/36; A63B 67/02

[52] U.S. Cl. ..... 473/150; 473/168

[58] Field of Search ..... 273/176 R, 176 A, 273/176 AA, 32 H, 162 A, 150, 168

[56] References Cited

U.S. PATENT DOCUMENTS

| | | | |
|---|---|---|---|
| 1,851,423 | 3/1932 | Ely | 273/176 A |
| 2,003,074 | 5/1935 | Gage | 273/176 A |
| 2,455,806 | 12/1948 | Reach | 273/176 A |
| 2,490,961 | 12/1949 | Hendry | 273/176 A |
| 3,464,703 | 9/1969 | Vallas | 273/176 A |
| 3,685,832 | 8/1972 | Johnson | 273/176 A |
| 4,655,451 | 4/1987 | Townsley | 273/32 H |
| 4,666,157 | 5/1987 | Bodine | 273/32 H |
| 4,783,071 | 11/1988 | Tattershall | 273/32 H |
| 4,798,385 | 1/1989 | Tegart | 273/176 A |

*Primary Examiner*—Sebastiano Passaniti
*Attorney, Agent, or Firm*—Thomas J. Tighe

[57] ABSTRACT

A golf ball receiving area can be the size of a conventional golf driving range, and is coordinately subdivided in area by pluralities of uniformly spaced latitude and longitude markers used for measuring both distance along and lateral deviation from an intended line of flight. At least one hitting area, small relative to the size of the receiving area, is adjacent the receiving area for simulating grassy driving areas of a golf course, e.g. a tee and a fairway. The intended line of flight preferably extends from the hitting area across the receiving area parallel to the longitude markers. Preferably near each hitting area is a small sand filled area, such as a small sand box, from which a player makes a sand shot. The sand areas simulate sand trap environments of a golf course. A score card depicts a birds-eye view of some or all the holes of a conventional golf course, and each hole depiction has longitudinal and latitudinal graduations. When a player drives a ball from either the hitting area or the sand area onto the receiving area, the player uses the longitude and latitude markers of the receiving area and the corresponding graduations on the depiction of the simulated hole being played to locate his or her ball on the depiction. A putting area, preferably having eighteen cups, and a chipping/pitching area are used for simulating a golf course's greens and chipping/pitching areas, respectively.

15 Claims, 3 Drawing Sheets

| HOLES | 1 | 2 | 3 | 4 | 5 | 6 |
|---|---|---|---|---|---|---|
| Champion | 476 | 157 | 457 | 497 | 460 | 480 |
| White | | | | | | |
| Handicap | 9 | 18 | 2 | 6 | 3 | 12 |
| Distance | | | | | | |
| Club | | | | | | |
| Distance | | | | | | |
| Club | | | | | | |
| Distance | | | | | | |
| Club | | | | | | |

| | | | | | | |
|---|---|---|---|---|---|---|
| Distance | | | | | | |
| Club | | | | | | |
| Sand play | | | | | | |
| Chips | | | | | | |
| Club | | | | | | |
| Putts | | | | | | |
| Penalties | | | | | | |
| Total | | | | | | |
| Par | 5 | 3 | 4 | 5 | 4 | 5 |

FIG. 3

RANGE GOLF SYSTEM

BACKGROUND OF THE INVENTION

This invention relates in general to the game of golf, and in particular to systems by which a golf player can play golf in a limited area while simulating play on a conventional golf course.

The system of this invention provides a way for a golfer to play a game of golf as if the golfer was playing on a conventional golf course, but without the time delays in walking the conventional golf course. Under this system, the player can enjoy all the benefits of playing a game of golf on a conventional golf course, but without the need to travel between each site where a ball is hit to where the ball lands. Under this system, a player can play an entire game of golf within a very small area relative to the size of a conventional golf course. So instead of the three to four hours required to play eighteen holes on a conventional golf course, a golfer can play eighteen simulated holes in a fraction of the time. Moreover, a golfer using this system does not need to lug a bag of clubs and other paraphernalia across the golf course or even rent a golf cart. In fact, under this system a golfer need not carry the bag of clubs anywhere except to a selected resting spot at the beginning of play.

Other advantages and attributes of this invention will be readily discernable upon a reading of the text hereinafter.

SUMMARY OF THE INVENTION

An object of this invention is to provide a system by which a golfer can effectively play a game of golf as if on a conventional golf course while remaining in a very small area relative to the size of a conventional golf course.

A further object of this invention is to provide a system by which a golfer can effectively play a game of golf as if on a conventional golf course, but in only a fraction of the time that would be required if the player was actually playing on a conventional golf course.

A further object of this invention is to provide a system by which conventional golf driving ranges can be adapted to achieve the above-stated purposes.

These objects, and other objects expressed or implied in this document, are accomplished by a golf playing system having several areas for simulating holes of a conventional golf course. A first area is for simulating grassy golf ball hitting areas of a golf course, e.g. tees and fairways. A second area is for simulating a sand trap of a golf course. A third area is for receiving golf balls hit by a player from the first and second areas. The third area is the size of a conventional golf driving range, preferably 300–400 yards deep. There are also markers within the third area for measuring the horizontal distance vector of a golf ball hit from the first or second areas onto the third area, the direction of the vector being relative to an intended line of flight. The markers are preferably longitudinal and latitudinal markings, such as graduated grid lines covering the third area. When a golfer hits a ball, the grid lines are used measure the distance the ball traveled as projected on an intended line of travel and the lateral deviation of the ball from an intended line of flight. These measurements determine the horizontal distance vector. There is also a graphic depiction of at least one hole of a real golf course. Preferably the depiction is part of a hand carried score card. A series (one or more) of distance vectors are plotted onto a reduced scale depiction of a hole of a golf course as if the series of hits represented by the vectors were made playing the hole. Preferably the score card depicts eighteen holes of an actual golf course. The second area is used by a player whenever the plotting of the vectors indicates that the player would be in a sand trap if the player had been playing the actual hole depicted. A fourth area is for simulating a putting green, the fourth area being used by a player whenever the plotting of the vectors indicates that the player would be on a putting green if the player had been playing the actual hole. The system can also have a fifth area for simulating a chipping area, the fifth area being used by a player whenever the plotting of the vectors indicates that the player would be in a chipping area if the player had been playing the actual hole.

BRIEF DESCRIPTION OF THE DRAWINGS

FIG. 3 depicts a second portion of a score card according to this invention, a portion having a matrix for keeping score.

DESCRIPTION OF THE PREFERRED EMBODIMENT

Figure 1:
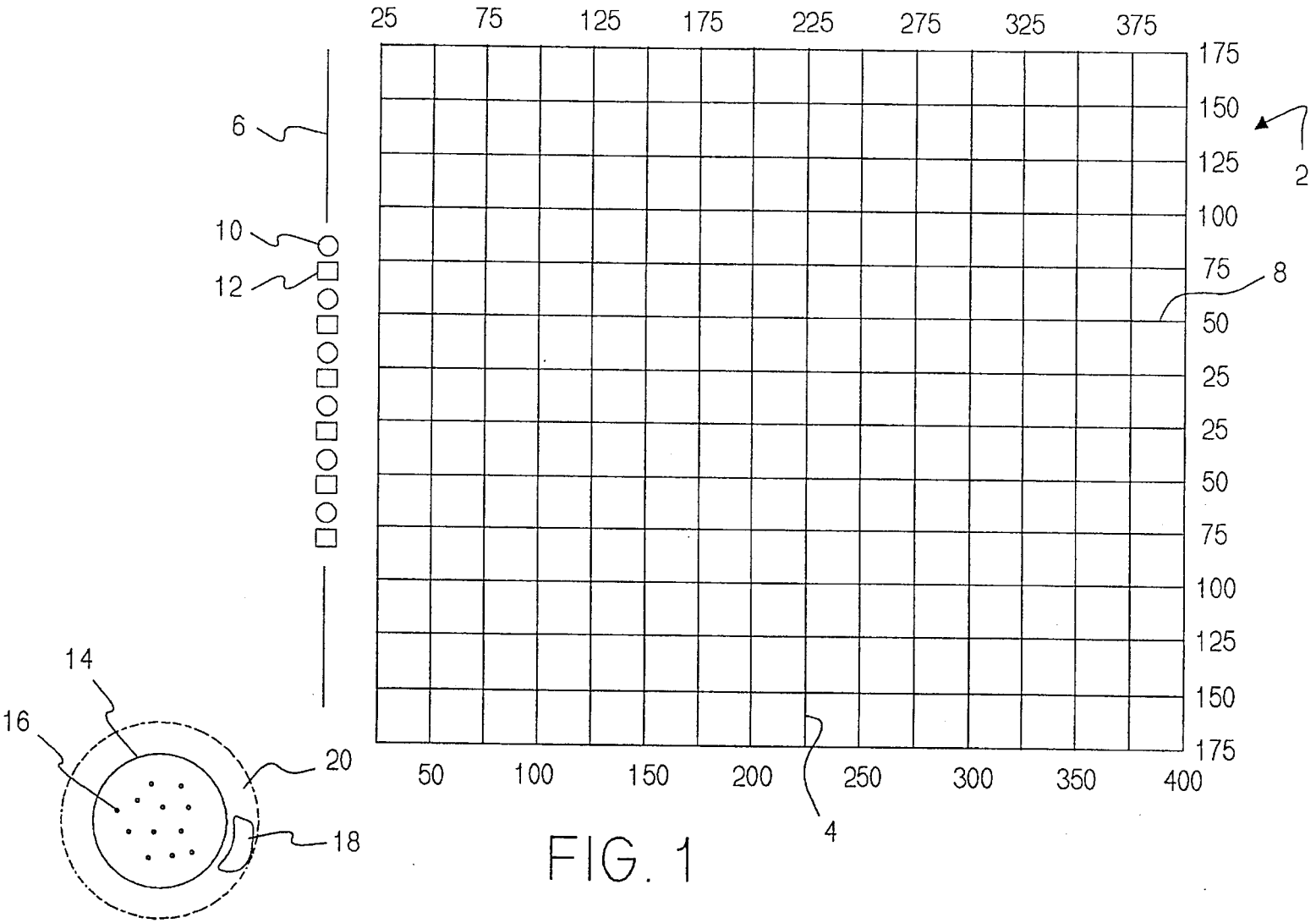
FIG. 1 is a diagrammatic plan view of a range golf course according to this invention.

Referring to FIG. 1, a "range golf" system according to this invention is illustrated to have a golf ball receiving area, generally designated 2, which can be the size of a conventional driving range, e.g. 300–400 yards long. The receiving area is coordinately subdivided in area by a plurality of uniformly spaced "latitude" markers, which are illustrated in this figure as parallel graduation lines 4, for marking uniform increments of distance from a driving line 6, and "longitude" markers 8, which are illustrated in this figure as parallel graduation lines, for marking uniform increments of width across the driving area. Along the driving line are a plurality of golf ball hitting areas 10 for simulating grassy playing areas of a golf course, such as tees and fairways. Also along the driving line are a plurality of areas 12 for simulating sand traps. Preferably sand traps are simulated by portable sand boxes large enough for a player to stand completely within each box on sand and hit a ball from the sand onto the receiving area. Adjacent the driving line is a putting area 14, such as a green 14 having a plurality of putting cups 16. Preferably there are eighteen such cups spaced apart to minimize interference between different groups playing different cups. Adjacent the putting area is a sand trap 18 and immediately surrounding the putting green is a chipping area 20.

Figure 2:
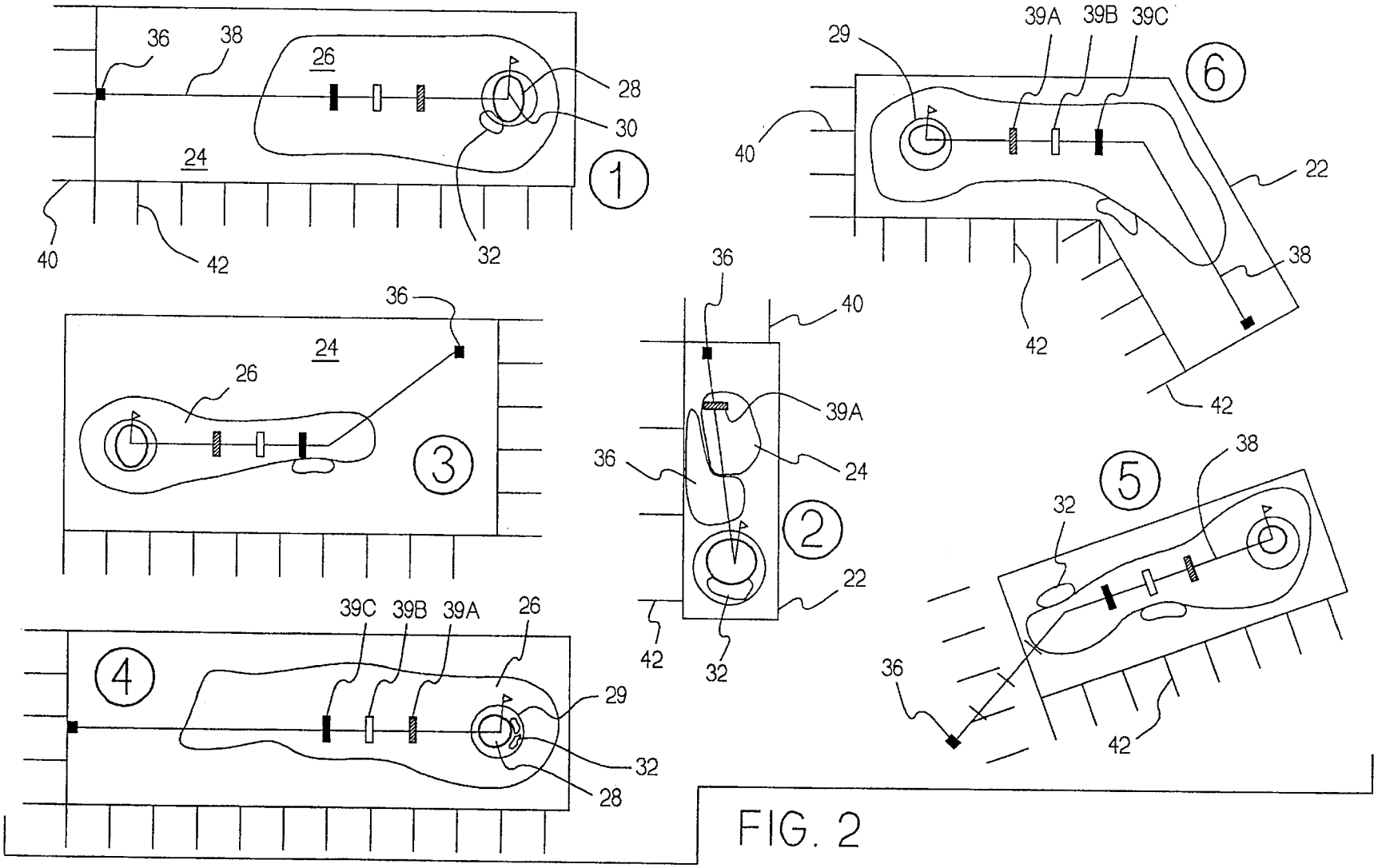
FIG. 2 depicts a first portion of a score card according to this invention, a portion having representations of the first six holes of a conventional golf course.

Referring to FIG. 2, a portion of a score card according to this system is illustrated to depict six holes of a conventional golf course as if viewed from above. While this Figure shows only six holes, it should be understood that the actual score card preferably depicts to a reduced scale eighteen holes of a conventional golf course in similar fashion. The inbounds area of each hole is defined by border lines 22. Within the border lines of each hole is a "rough" area 24, a fairway 26, and green 28. A chipping area is marked by a circle 29 around the green. The particular cup in each green is indicated by a flag 30. Each hole can have one or more sand traps 32. As illustrated, hole number two even has a water hazard 34. Also indicated for each hole by a darkened square 36 is the tee for the hole. Extending from the tees to the flags of each hole are straight or bent lines 38 which indicate the recommended lines of flight for the holes. Each hole can also have one or more variously colored markers for indicating distance remaining to the flag. As illustrated the cross-hatch marker 39A marks a distance of 100 yards from the hole, the clear marker 39B for 150 yards from the hole and the black marker 39C for 200 yards from the hole. Each hole is also marked by longitudinal graduations 40 and lateral graduations 42 both of which are in increments of fifty yards. These graduations help a player plot the vector for each drive and subsequent hit for each hole.

In the operation of playing a simulated hole, one depicted on the score card, a player first tees-up at one of the simulated grassy areas and drives a golf ball onto the receiving area. The intended line of flight is preferably parallel to the nearest longitudinal grid line. The distance vector for the drive is determined using the latitudinal grid lines for distance measurement, and the longitudinal grid lines for measurement of the deviation from the intended line of flight. The player then plots the vector on the score card depiction of the hole. The vector is plotted at a reduced scale as indicated by the graduations on the depiction of the hole. The vector is plotted by using the tee of the hole as an origin, and the direction of the vector is preferably relative to the recommended line of flight as marked on the hole. At least the end point of the vector should be marked on the hole depiction. If the end point of the vector lies in a grassy area of the hole but not on the green or chipping area, the player chooses his or her next club depending on the distance remaining to the green and takes the second stroke on the simulated grassy area. The vector of the second stroke is then plotted on the hole with the end point of the first vector as the origin and the direction of the second vector again relative to the recommended line of flight. In this fashion successive stroke vectors are plotted until the plot indicates that the player has landed on the green or at least within the chipping area. Then the player moves to the putting green if the former is true, or the chipping area if the latter is true. A ball is then dropped and the player finishes the simulated hole by chipping and/or putting toward a cup corresponding to the simulated hole being played. Afterward the player returns to a simulated grassy area to begin the next hole. To play any number of simulated holes, the player need only move between the simulated grassy area, the chipping/putting area, and maybe the simulated sand area, and preferably they are all close together at a front end of the receiving area.

A significant advantage of this invention is that, as explained below, the player or players can chose to finish fairway play for all holes before moving to the chipping/putting area, and then do the chipping and putting for all the holes.

Whenever the plot indicates that a player has landed in a sand trap, the player moves to a nearby simulated sand area, drops the ball into it, and takes his or her next stroke from the sand. If the plot of the next stroke indicates that the player has landed in a grassy area but not on the green or chipping area, the player chooses his or her next club depending on the distance remaining to the green and takes the next stroke from the simulated grassy area.

Referring to FIG. 3, illustrated is another portion of the score card which is preferably attached to the portion described above with reference to FIG. 2. This second portion contains information for each hole such as the yardage for each hole listed in a row labeled "Champion," the handicap for each hole listed in a row "Handicap" and the par for each hole listed in a row labeled "Par." There are also a plurality of blank rows labeled "Distance" and for each such blank row is an adjacent blank row labeled "Club."

For play according to this system, standard clubs should be used with a limit of fourteen total clubs allowed for open and senior play. With junior and youth play, clubs manufactured for range golf youth play should be used. Youth play may share all clubs except for putters. Maximum play from one bag should be four players.

Fairway play can be played with the range balls supplied by the proprietor of the course. Chipping and putting should be played using a golfer's own balls. Any brand official size and weight balls may be used. Balls that land out of bounds (as indicated by a plotted vector ending outside the borders of the hole as depicted on the score card) are played with a one stroke penalty, loss of distance. Balls that fall into water hazards are played with a one stroke penalty, no loss of distance. Balls that land in a fairway sand trap are played from an adjacent sand box 12 (FIG. 1), no penalty. Balls that land in a putting green sand trap are played at the chipping/putting area, no penalty. Balls that land in sand traps are placed in a sand box or putting green sand trap by drops only. All fairway play is played from the same teeing area, i.e. the simulated grassy area. Tees are permitted with the first stroke for each hole played. Except for sand play, all teeing area play allows for placing the ball by dropping or bumping the ball. An improved lie is authorized. Unintentional movement to the ball does not count as a stroke. Only intentional attempts to hit the ball count as a strokes.

Gauging the distance and the off-line flight is a player's responsibility and is plotted on the course layout portion of the score card (e.g. FIG. 2) after each stroke. Plotting is done by using the coordinate markings 4 and 8 of FIG. 1. By plotting the vector of each stroke, the course layout will reveal the player's remaining distance to the flag stick. Failure of the player to plot his or her stroke is a one shot penalty.

Each player hits in rotation for each fairway hole until their total distance equals that distance shown on the plotting card that will leave them either on the green or inside the thirty yard ring, which is signified by the black circle. Preferably once all eighteen fairways have been played, the players move off the teeing grounds to the chipping/putting areas. All players spot or mark their ball location for the number one hole and play resumes. The player with honors is the player farthest from the flag stick. When all play has ended, all players total all strokes for each hole and total all eighteen holes. The player then enters his or her handicap rating and adjusts his or her gross score to their net total.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims.

I claim:

1. A golf play simulation system comprising:

(a) first area means for simulating at least one grassy hitting area of a golf course, (b) second area means for simulating a sand trap of a golf course, (c) third area means for receiving golf balls hit by a player from the first or second area means, (d) means for a player disposed at the first area means to determine the horizontal distance vector of a golf ball hit from the first or second area means onto the third area means, the direction of the vector being relative to an intended line of flight, (e) means for plotting a series of such horizontal distance vectors onto a reduced scale depiction of a hole of a golf course as if the series of hits represented by the vectors were made actually playing the depicted hole, the second area means being used by a player as a base for hitting whenever a vector last plotted terminates in a sand trap depiction of the depicted hole, (f) fourth area means for simulating a putting area, the fourth area means being used by a player after the plotting of the vectors indicates that the player would have reached a green of the depicted hole if the player had been actually playing the depicted hole.

2. The system according to claim 1 further comprising fifth area means for simulating a chipping area, the fifth area means being used by a player after the plotting of the vectors indicates that the player would have reached a chipping area of the depicted hole if the player had been actually playing the depicted hole.

3. The system according to claim 2 wherein the means for determining the horizontal distance vector comprises:

(a) means for measuring the total distance a hit golf ball travels as projected along an intended line of flight, and (b) means for measuring the total lateral deviation, if any, a hit golf ball travels from the intended line of flight, the total distance and total deviation and direction of deviation defining the horizontal distance vector.

4. The system according to claim 3 wherein the means for plotting comprises a reduced scale illustration of the hole, and graduations marking the illustration, some of said graduations corresponding to the means for measuring the total distance and some of said graduations corresponding to the means for measuring the total lateral deviation.

5. The system according to claim 4 further comprising reduced scale illustrations of eighteen holes of a golf course.

6. The system according to claim 2 wherein the means for determining the horizontal distance vector comprises:

(a) longitudinal marker means for measuring the total distance a hit golf ball travels as projected along an intended line of flight, and (b) latitudinal marker means for measuring the total lateral deviation, if any, a hit golf ball travels from the intended line of flight, the total distance and total deviation and direction of deviation defining the horizontal distance vector.

7. The system according to claim 6 wherein the means for plotting comprises a reduced scale illustration of the hole, and graduations marking the illustration, some of said graduations corresponding to the longitudinal marker means and some of said graduations corresponding to the latitudinal marker means.

8. The system according to claim 7 further comprising reduced scale illustrations of eighteen holes of a golf course.

9. The system according to claim 1 further comprising reduced scale depictions of eighteen holes of a golf course.

10. The system according to claim 1 wherein the means for determining the horizontal distance vector comprises:

(a) means for measuring the total distance a hit golf ball travels as projected along an intended line of flight, and (b) means for measuring the total lateral deviation, if any, a hit golf ball travels from the intended line of flight, the total distance and total deviation and direction of deviation defining the horizontal distance vector.

11. The system according to claim 10 wherein the means for plotting comprises a reduced scale illustration of the hole, and graduations marking the illustration, some of said graduations corresponding to the means for measuring the total distance and some of said graduations corresponding to the means for measuring the total lateral deviation.

12. The system according to claim 11 further comprising reduced scale illustrations of eighteen holes of a golf course.

13. The system according to claim 1 wherein the means for determining the horizontal distance vector comprises:

(a) longitudinal marker means for measuring the total distance a hit golf ball travels as projected along an intended line of flight, and (b) latitudinal marker means for measuring the total lateral deviation, if any, a hit golf ball travels from the intended line of flight, the total distance and total deviation and direction of deviation defining the horizontal distance vector.

14. The system according to claim 13 wherein the means for plotting comprises a reduced scale illustration of the hole, and graduations marking the illustration, some of said graduations corresponding to the longitudinal marker means and some of said graduations corresponding to the latitudinal marker means.

15. The system according to claim 14 further comprising reduced scale illustrations of eighteen holes of a golf course.

* * * * *